United States Patent [19]

Kofmel

[11] 4,070,556

[45] Jan. 24, 1978

[54] PLUG-AND-SOCKET CONNECTION

[76] Inventor: Rudolf Kofmel, Schulhausstrasse 99, Deitingen, Solothurn, Switzerland, 4707

[21] Appl. No.: 725,892

[22] Filed: Sept. 22, 1976

[30] Foreign Application Priority Data

Sept. 29, 1975 Switzerland ..... 12607/75

[51] Int. Cl.[2] ..... H01R 33/30

[52] U.S. Cl. ..... 200/16 B; 200/51.09

[58] Field of Search ..... 200/51 R, 51.07, 51.09, 200/51.12, 51.13, 51.14, 16 B, 163

[56] References Cited

U.S. PATENT DOCUMENTS

| | | | |
|---|---|---|---|
| 1,554,981 | 9/1925 | Aiken | 200/51.09 X |
| 3,046,515 | 7/1962 | Appleton | 200/51.13 |
| 3,204,053 | 8/1965 | Bilek | 200/51.09 |
| 3,373,274 | 3/1968 | Kott | 200/51.09 X |
| 3,387,104 | 6/1968 | Friend | 200/51.09 X |
| 3,536,870 | 10/1970 | Izumi | 200/51.09 X |
| 3,944,316 | 3/1976 | Newman et al. | 200/51.09 X |

FOREIGN PATENT DOCUMENTS

| | | | |
|---|---|---|---|
| 225,276 | 11/1924 | United Kingdom | 200/51.09 |

*Primary Examiner*—Thomas J. Kozma
*Attorney, Agent, or Firm*—Townsend and Townsend

[57] ABSTRACT

An electrical plug and socket connection which has an axially symmetrical plug body, a central aperture in the plug body for receiving a multi-conductor electrical cable and a cylindrical extension secured to the plug body in alignment with the axis thereof which defines a stop surface at the end thereof remote from the plug body. At least one contact ring is disposed coaxially with the extension between the plug body and the stop surface. The contact ring has an exposed outer surface. At least one contact element defined by a radially movable stud secured to one end of a flat spring projects partially into a cavity of the socket portion for cooperation with the contact ring. When the extension of the plug is inserted into the socket the stud and the associated flat spring are pushed radially outward with respect to the axis of the extension into electrical contact with a life terminal of the socket to thereby act as a switch which is closed upon the insertion of the extension into the socket and which electrically connects the contact ring with the life terminal.

4 Claims, 3 Drawing Figures

PLUG-AND-SOCKET CONNECTION

This invention relates to plug-and-socket connections. More particularly, it relates to a plug-and-socket connection for connecting at least two electric conductors of a cable to two other electric conductors, of the type wherein a socket portion having at least two terminals for the two other electric conductors is provided with a cavity for receiving part of a plug portion.

Known plug-and-socket connections, e.g., conventional plugs and electrical outlets for connecting an electric load to the power-supply system, respectively comprise prongs or pins and sockets which, upon insertion of the plug into the outlet for establishing the electrical connection, are pushed one into the other. When the plug is pulled out of the outlet, it may happen that when it is partway out, the plug body is grasped by its end face as well, so that the partially exposed prongs or pins of the plug, which are still live, may be inadvertently touched. This can lead to accidents which should be avoided. Furthermore, it has often happened that children, while playing, push pointed metal objects into the holes of the electrical outlet and thus contact the live socket parts.

In order to eliminate this risk, electrical outlets have already been proposed which have a rotatable, apertured disc disposed behind the face plate having the holes for insertion of the plug prongs or pins; when the plug is to be inserted, the apertures must be aligned with the holes in the face plate, and when the outlet is not in use, the disc must be rotated manually or by the action of a spring so that the holes are covered. Such outlets prevent children at play from reaching the live parts thereof. However, in order to use the outlet, an additional manipulation is necessary before the plug can be inserted. Moreover, the possibility of touching the live, partially withdrawn pins or prongs is not precluded in the case of outlets of this kind.

It is an object of this invention to provide a plug-and-socket connection of the type initially described which does not possess the above-mentioned drawbacks of the prior art designs.

To this end, in the plug-and-socket connection according to the present invention, the improvement comprises an axially symmetrical plug body, a central aperture in the plug body for receiving the cable, a cylindrical extension secured to the plug body in alignment with the axis of the plug body, this extension having a stop surface at the end thereof remote from the plug body, at least one contact ring disposed coaxially with the extension between the plug body and the stop surface, the contact ring having an exposed outer surface, at least one contact element projecting partially into the cavity of the socket portion for cooperation with the contact ring, and switch means disposed on the socket portion for cooperation with the stop surface upon insertion of the extension into the cavity, whereby the contact element is electrically connectible to one of the terminals.

A preferred embodiment of the invention will now be described in detail with reference to the accompanying drawing, in which.

Figure 1:
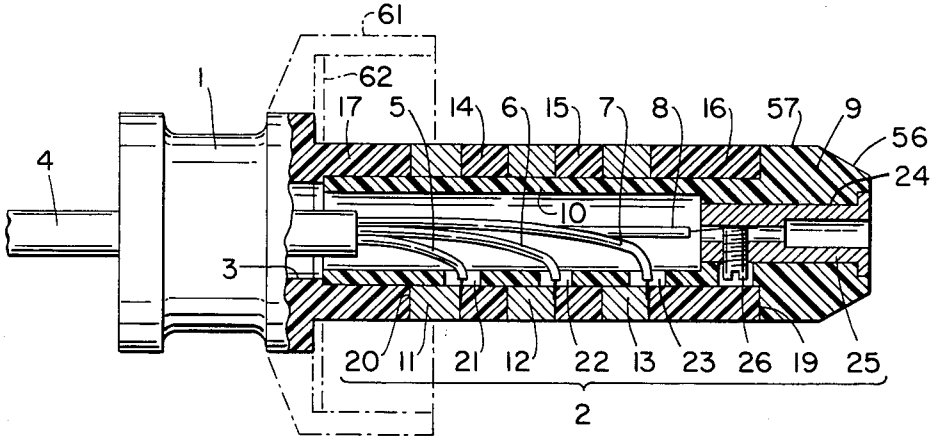
FIG. 1 is an elevation, partially in longitudinal section, of a plug portion.

The plug portion illustrated in FIG. 1 comprises a plug body 1 from which a cylindrical extension 2 projects. The plug body 1 has a central aperture 3 for receiving a cable 4 which comprises, for example, four electric conductors 5, 6, 7 and 8. Within the aperture 3 there are means (not shown) for securing the cable 4 inside the plug body 1. The extension 2 comprises a number of parts, i.e., an end piece 9 having a tubular prolongation 10, three contact rings 11, 12, and 13, and three spacer rings 14, 15, and 16. An annular projection 17 of the plug body 1 also belongs to the extension 2. The projection 17 is provided with an internal thread into which the externally-threaded end of the prolongation 10 is screwed.

The plug body 1, the end piece 9, and the spacer rings 14, 15, and 16 are made of an electrically insulating synthetic material. The contact rings 11, 12 and 13 and the spacer rings 14, 15, and 16 are fitted on the tubular prolongation 10 of the end piece 9 and held in place between a supporting shoulder 19 of the end piece 9 and the end face 20 of the projection 17 of the plug body 1. At the points where each of the contact rings 11, 12, and 13 adjoins the neighboring spacer rings 14, 15 and 16, respectively, there are three openings 21, 22, and 13, respectively, in the tubular prolongation 10, through which openings the conductors 5, 6 and 7, respectively, of the cable 4 extend. Each of the stripped ends of the conductors 5, 6 and 7 is disposed in a radially-extending groove (not shown in detail) in the contact or spacer ring, the depth of the groove being less than the diameter of the stripped end of the conductor. Hence the bare conductors are very tightly pressed against the contact rings 11, 12 and 13 and held fast. A sleeve forming a jack 25 is pressed into a longitudinal bore 24 in the end piece 9, the wall of the sleeve being thicker in the part nearest the plug body 1 than in the part remote the plug body 1. The stripped end of the conductor 8 extends into the thicker-walled part and is secured there by means of a grub screw 26.

Figure 2:
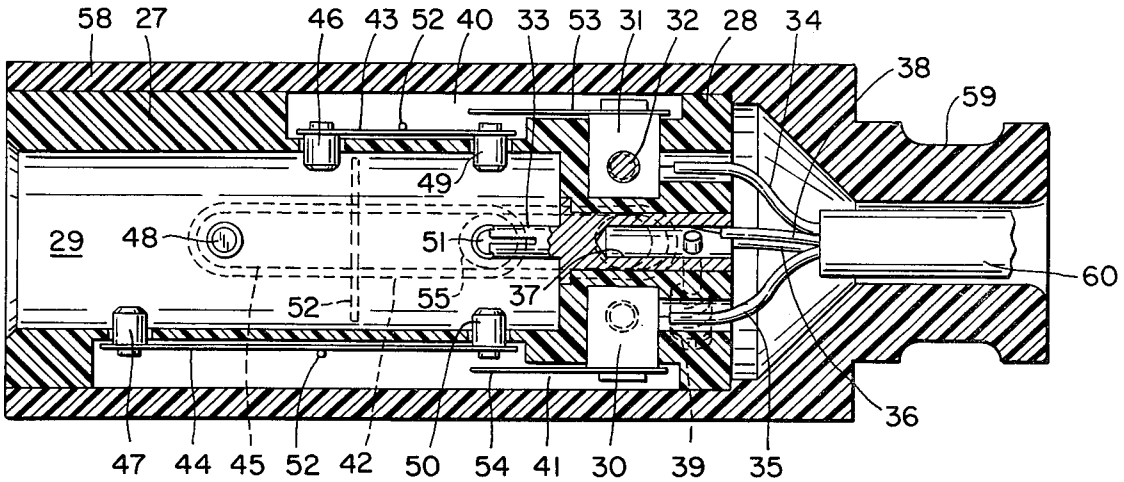
FIG. 2 is a longitudinal section through a socket portion into which the plug portion of FIG. 1 is intended to be inserted.
Figure 3:
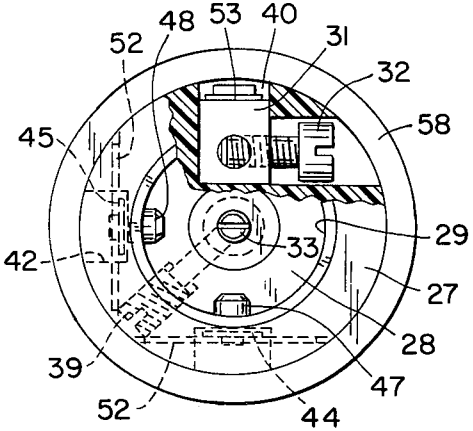
FIG. 3 is an end-on view of the socket portion of FIG. 2, partially in section.

FIGS. 2 and 3 show the socket portion comprising a tubular insulator 27, one end of which is closed off by a relatively thick base 28. The tubular insulator 27 and the base 28 together define a cylindrical cavity 29 which is somewhat larger than the extension 2 of the plug portion. Disposed in the base 28 are three terminals, only two of which, 30 and 31, are visible in FIG. 2, and only one of which, 31, is visible in FIG. 3. Each terminal includes a screw 32 for clamping in one of three further conductors 34, 35 and 36, respectively. Only one of the screws 32 is visible in FIG. 3. Disposed in the center of the base 28 is a pin 33, part of which projects axially into the cavity 29 and is intended to enter the jack 25 in the extension 2 of the plug portion. In the part of the pin 33 remote from the cavity 29 is a blind bore 37 for receiving a further conductor 38, which is held fast by a screw 39 passing radially through the base 28. Extending out from the terminals parallel to the longitudinal axis of the insulator 27 are grooves 40, 41, and 42, which are deeper in the region of the insulator 27 than in the region of the base 28. On the deeper bottoms of the grooves 40, 41 and 42 lie flat springs 43, 44, and 45, respectively. At the ends of these flat springs nearest the open end of the cavity 29, respective studs 46, 47, and 48 are secured, which partially project into the cavity 29 through corresponding openings in the groove bottoms. Secured to the other ends of the flat springs 43, 44, and 45 are respective contact nipples 49, 50, and 51, which likewise project into the cavity 29 through corresponding openings in the groove bottoms. Each of the flat springs 43, 44, and 45 is held in the associated groove 40, 41, and 42 by means of a locking pin 52 passing transversely through each of these grooves.

On the shallower bottoms of the grooves 40, 41 and 42 lie respective second flat springs 53, 54, and 55. One end of each of these second flat springs is secured in the groove bottom to a respective one of the three terminals, while the other end is positioned above a respective one of the contact nipples 49, 50 and 51.

The socket portion described above may, for example, be disposed in an electrical outlet (not shown), in which case the three terminals may be connected to the three-phase conductors of the house line and the pin 33 to the neutral conductor of the house line. When the plug portion is not inserted in the cavity 29 of the socket portion, the studs 46, 47 and 48 and the contact nipples 49, 50 and 51 are all dead because the latter are kept spaced from the second, live flat springs 53, 54 and 55 by the action of the flat springs 43, 44 and 45.

The end piece 9 of the extension 2 of the plug portion is slightly tapered and forms a ramp surface 56 adjoining a cylindrical stop surface 57 for the contact nipples 49, 50 and 51. When the extension 2 is inserted into the cavity 29, the studs 47, 48 and 46 are moved radially outwards in that order. Not until the end piece 9 reaches the vicinity of the contact nipples 49, 50 and 51 are these contact nipples moved radially outwards simultaneously, whereby the studs 46, 47 and 48 are electrically connected to the associated terminals via the various flat springs. When the extension 2 has reached its final position in the cavity 29, each of the studs 46, 47 and 48 rests against one of the contact rings 13, 11 and 12, respectively, the pin 33 is situated in the jack 25, and the electricl connection of the individual conductors 5, 6, 7 and 8 of the cable 4 to the phase conductors and the neutral conductor of the house line is established.

When the extension 2 is pulled out of the cavity 29, the contact nipples 49, 50 and 51 are first separated from the associated flat springs 53, 54 and 55 before the first contact ring 11 leaves the cavity 29. There is no danger in touching the contact rings as they come out because all of the studs are then dead.

The socket portion may, as illustrated in FIGS. 2 and 3, take the form of a negative connection part, so that the plug-and-socket connection according to the present invention may be used for the connection elements of an extension cord. For this purpose, the socket portion as described above is surrounded by a cylindrical jacket 58, the end of which nearest the base 28 takes the form of a grip 59. Means (not shown) are disposed within the grip 59 for securing an extension cord 60. The extension cord 60 will preferably be cast integrally with synthetic resin in the grip 59 and in the recess between the base 28 and the grip 59, in order to obtain a fluid-tight closure. In this case, a bell-shaped part 61 is molded on the plug body 1 of the plug portion according to FIG. 1, which part 61 partially encompasses the jacket 58 to form a fluid-tight closure by means of a sealing ring 62. The bell-shaped part 61 may have an internal thread and the jacket 58 an external thread so that the plug portion may be screwed onto the jacket 58 of the socket portion.

A further advantage of the plug-and-socket connection as described above is that the extension 2 can be inserted in the cavity 29 without difficulty, even in the dark, because the extension 2 need not be inserted in any particular position of rotation with respect to the socket portion.

If the extension 2 is 12 mm. in diameter and 46 mm. long, for example, the socket portion can quite easily be accommodated in the space occupied by a previously known electrical outlet.

The extension 2 may also have fewer than three contact rings. For a normal load, such as a household vacuum cleaner, it suffices if the extension has either two contact rings or one contact ring and the jack. The socket portion may likewise have fewer than three studs and contact nipples depending upon how many phases of the power-supply system are to be connected to the load.

What is claimed is:

1. In a plug-and-socket connection for connecting at least two electric conductors of a cable to two other electric conductors, of the type wherein a socket protion having at least two terminals for said two other electric conductors is provided with a cavity for receiving part of a plug portion, the improvement comprising:

an axially symmetrical plug body, a central aperture in said plug body for receiving said cable, a cylindrical extension secured to said plug body in alignment with the axis of said body, said extension having a stop surface at an end thereof remote from said body, at least one contact ring disposed coaxially with said extension between said plug body and said stop surface, said contact ring having an exposed outer surface, at least one contact element comprising a radially movable stud secured to one end of a first flat spring, said stud projecting partially into said cavity of said socket portion for cooperation with said contact ring so that said stud rests against said contact ring upon complete insertion of said extension into said cavity, and switch means disposed on said socket portion for cooperation with said stop surface upon insertion of said extension into said cavity, said switch means comprising a contact nipple secured to an other end of said first flat spring and a second flat spring secured to one of said terminals and partially overlapping said first flat spring, whereby said contact nipple contacts said second flat spring upon complete insertion of said extension into said cavity.

2. A plug-and-socket connection in accordance with claim 1, wherein said first and second flat springs are disposed parallel to the longitudinal axis of said cavity, said socket portion further comprising a locking pin disposed at right angles to said first flat spring between said stud and said contact nipple for pressing said stud and said nipple towards the interior of said socket portion.

3. A plug-and-socket connection in accordance with claim 2 for establishing a three-phase connection with protective grounding, wherein said extension comprises an axially-extending jack disposed in the end of said extension remote from said plug body, said socket portion further comprising a pin extending into said cavity from the center of the back thereof along the longitudinal axis thereof for cooperation with said jack upon insertion of said extension into said cavity, and wherein said extension comprises two further contact rings staggered axially with respect to said at least one contact ring, and said socket portion comprises two further contact nipples and two further studs staggered axially with respect to said stud forming said at least one contact element, all said contact nipples being disposed in a plane perpendicular to the longitudinal axis of said cavity and being positioned at different angles to one another.

4. In a plug-and-socket connection for connecting at least two electric conductors of a cable to two other electric conductors, of the type wherein a socket portion having at least two terminals for said two other electric conductors is provided with a cavity for receiving part of a plug portion, the improvement comprising:

an axially symmetrical plug body, a central aperture in the plug body for receiving the cable, a cylindrical extension secured to the plug body in alignment with the axis of the body, the extension having a stop surface at an end thereof remote from the body and further comprising an axially extending jack disposed in the end of the extension remote from the plug body, at least one contact ring disposed coaxially with the extension between the plug body and the stop surface, the contact ring having an exposed outer surface, at least one contact element projecting partially into the cavity of the socket portion for cooperation with the contact ring, the socket portion further comprising a pin extending into the cavity from a center of a back thereof along the longitudinal axis thereof for cooperation with the jack upon insertion of the extension into the cavity, and switch means disposed on the socket portion for cooperation with the stop surface upon insertion of the extension into the cavity, whereby the contact element is electrically connectible to one of the terminals.

* * * * *